US006313582B1

(12) United States Patent
Miyanaga et al.

(10) Patent No.: US 6,313,582 B1
(45) Date of Patent: Nov. 6, 2001

(54) CERAMIC LAMP

(75) Inventors: Shouji Miyanaga, Takasago; Mitsuru Ikeuchi, Himeji; Kazuyuki Mori, Himeji; Yukiharu Tagawa, Himeji, all of (JP)

(73) Assignee: Ushiodenki Kabushiki Kaisha

( * ) Notice: Subject to any disclaimer, the term of this patent is extended or adjusted under 35 U.S.C. 154(b) by 0 days.

(21) Appl. No.: 09/398,035

(22) Filed: Sep. 17, 1999

(30) Foreign Application Priority Data

Sep. 18, 1998 (JP) ..... 10-282055

(51) Int. Cl.[7] ..... H01J 61/00

(52) U.S. Cl. ..... 313/623; 313/625; 313/626; 313/578; 313/570

(58) Field of Search ..... 313/623, 624, 313/625, 626, 572, 578, 579, 570

(56) References Cited

U.S. PATENT DOCUMENTS

| | | | | |
|---|---|---|---|---|
| 4,475,061 | * | 10/1984 | Van De Weijer et al. | 313/570 X |
| 4,560,903 | * | 12/1985 | Sneijers et al. | 313/625 |
| 4,602,956 | | 7/1986 | Partlow et al. . | |
| 5,532,552 | * | 7/1996 | Heider et al. | 313/623 |

FOREIGN PATENT DOCUMENTS

| | | | |
|---|---|---|---|
| 0 220 813 | | 5/1987 | (EP) . |
| 0 528 428 | | 2/1993 | (EP) . |
| 0 751 549 | | 1/1997 | (EP) . |
| 0063871 | * | 4/1985 | (JP) ..... 313/623 |
| 0334995 | * | 12/1993 | (JP) ..... 313/625 |
| 8-264155 | | 10/1996 | (JP) . |

OTHER PUBLICATIONS

Patent Abstracts of Japan, vol. 1997, No. 02, Feb. 28, 1997, & JP 08 264155 A, Kyocera Corp., Oct. 11, 1996, English Abstract.

* cited by examiner

*Primary Examiner*—Ashok Patel
(74) *Attorney, Agent, or Firm*—Nixon Peabody LLP; David S. Safran

(57) ABSTRACT

A ceramic lamp in which the hermetically sealing bodies of electrically conductive cermet are sealed to hermetically sealed tube portions of the lamp vessel with a sealing material is arranged and provided with material components designed to give the hermetically sealing portions a high reliability. In particular, a lamp of a translucent ceramic has a lamp vessel which has a bulb portion and hermetically sealed tube portions which are connected to the bulb portion, and electrically conductive supply components in the bulb portion which have base parts inserted into the hermetically sealed bodies of electrically conductive cermet, is improved by seal welding of the hermetically sealing bodies of electrically conductive cermet on the hermetically sealed tube portion with a sealing material so that a hermetically sealed arrangement is produced in which, in the border area between the sealing material and the hermetically sealing body, an intermediate layer is formed in which components of the electrically conductive cermet of the hermetically sealing body are intermixed with components of the sealing materials.

20 Claims, 4 Drawing Sheets

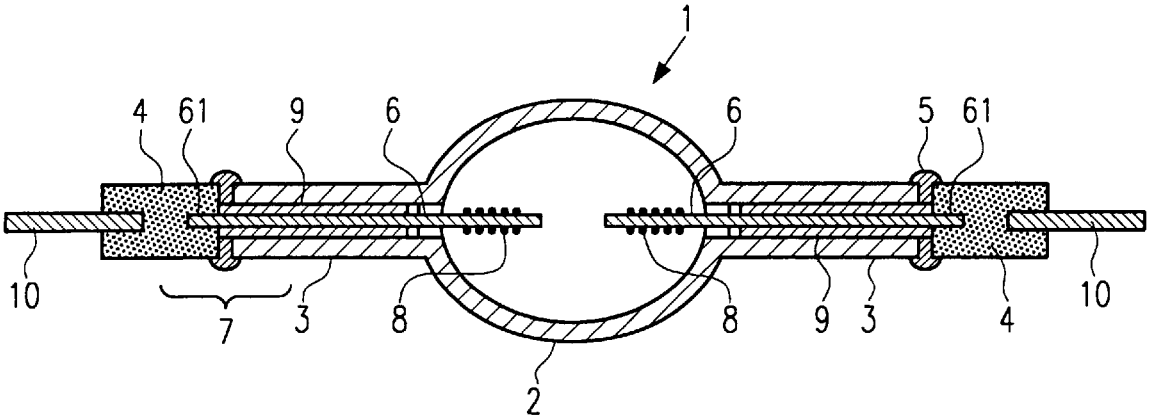
FIG. 1
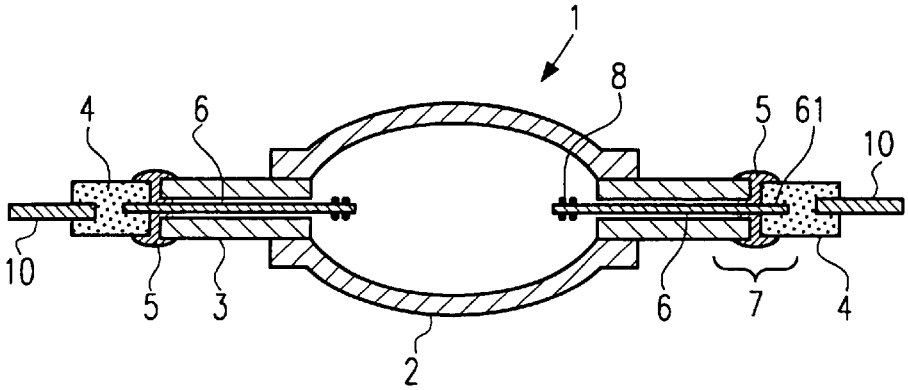
FIG. 2
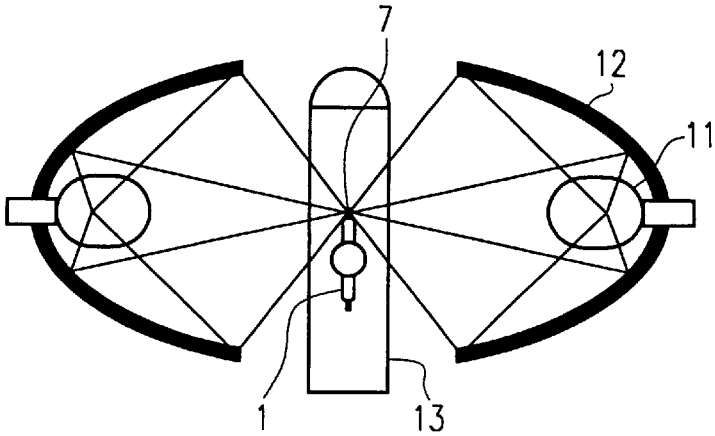
FIG. 3 arrangement of a photofurnance

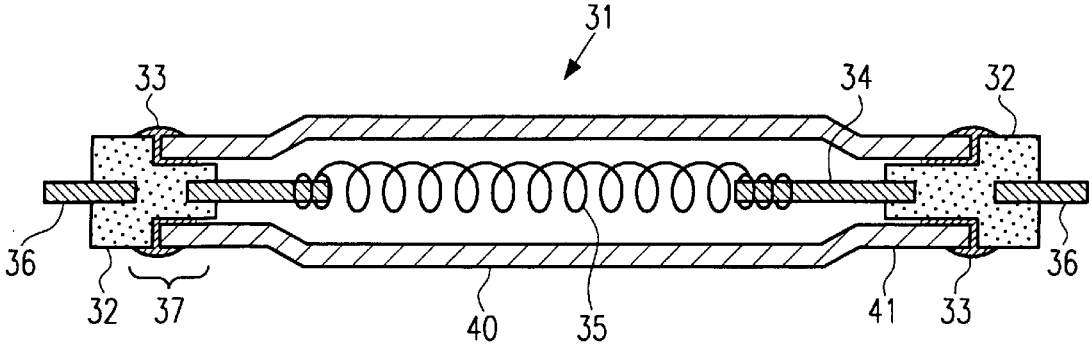
FIG.10
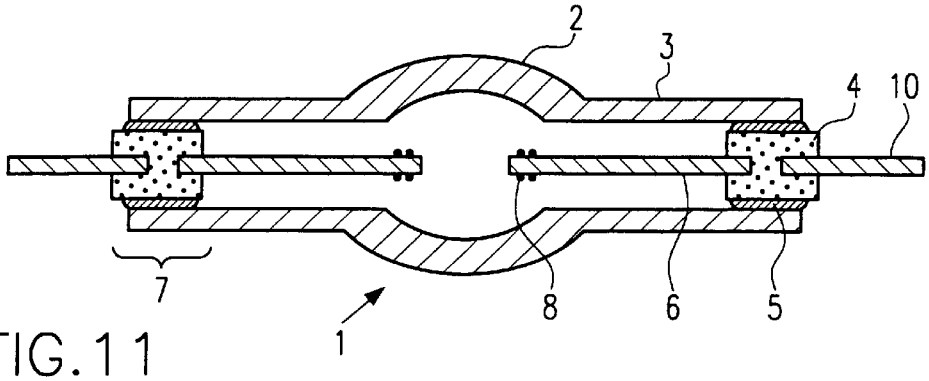
FIG.11
(Prior Art)
| Diameter of upholding part of the electrode d (mm) | Coef. linear exp. (x $10^{-6}$/K) | | $\lvert y - u \rvert$x d (x $10^{-9}$) (m/k) | Ratio of crack formation |
|---|---|---|---|---|
| | u | y | | |
| 0.3 | 4.7 | 7.2 | 0.75 | 0/30 |
| 0.5 | 4.7 | 7.2 | 1.25 | 2/30 |
| 0.6 | 4.7 | 5.7 | 0.6 | 0/30 |
| 0.8 | 4.7 | 5.7 | 0.8 | 0/30 |
| 1.2 | 4.7 | 5.7 | 1.2 | 0/30 |
| 1.5 | 4.7 | 7.2 | 3.75 | 15/30 |
| 1.5 | 4.7 | 5.7 | 1.5 | 3/30 |
FIG.12

CERAMIC LAMP

BACKGROUND OF THE INVENTION

1. Field of the Invention

The invention relates to a ceramic lamp having a lamp vessel made of translucent ceramic and using a hermetically sealing body of electrically conductive cermet to route current into the lamp vessel, the sealing body being hermetically sealed relative to sealing portions of the lamp vessel via a sealing material.

2. Description of Related Art

In a ceramic lamp, in which the lamp vessel is made of a translucent ceramic and an electrically conductive cermet is used for the hermetically sealing body, and thus current is routed into the lamp vessel, and in which the lamp vessel is hermetically sealed relative to the sealing body using a sealing material, conventionally several sealing processes are performed.

FIG. 11 shows, for example, an arrangement in which a hermetically sealing tube portion 3 is connected on opposite ends of a bulb portion 2, and the periphery of a hermetically sealing bodies 4 of electrically conductive cermet are sealed relative to the inside wall of the tube portions 3 of the lamp vessel 1 using a sealing material 5, and thus, hermetically sealed portions 7 are formed. One such lamp is described, for example, in laid-open Japanese Patent Application HEI 8-264155.

Furthermore, a process is known in which, in one of the hermetically sealed ends of a lamp with bilateral hermetic seals (of the double-end type), a hermetically sealing body of electrically conductive cermet and a hermetically sealed tube portion of the lamp vessel are sintered to one another in one part, and in which the other hermetically sealed end, upon evacuation of the lamp, is sealed with a sealing material.

Moreover, a process is known in which thin molybdenum tubes are pushed through the hermetically sealing bodies of electrically conductive cermet, embedded and sintered in part with the lamp vessel, and in which evacuation is performed through the molybdenum tube.

However, if the hermetically sealing bodies of electrically conductive cermet are enclosed with a sealing material in a hermetically sealed tube, there are differences in the coefficients of linear expansion between the respective components of the hermetically sealed portions, i.e., between the hermetically sealed tube, the hermetically sealing body, the sealing material and the electrically conductive supply component, such as the upholding part of the electrode and the like. Therefore, there are cases in which cracks form in these hermetically sealing portions, or as a result of these cracks, leaks occur. In the hermetically sealed portions of a conventional ceramic lamp in which the electrically conductive cermet which is conventionally present is used as the hermetically sealing body, to date sufficiently reliability could not be achieved.

SUMMARY OF THE INVENTION

Therefore, a primary object of the present invention is to provide a ceramic lamp in which the hermetically sealing bodies of electrically conductive cermet in the hermetically sealed tube portion of the lamp vessel are sealed with a sealing material in a manner which reduces the difference of the coefficients of linear expansion between the components of the lamp, and at the same time, and to otherwise insure that the arrangement and material components of the hermetically sealed portions have a high reliability and are tight.

In a discharge lamp of translucent ceramic which has a lamp vessel which has a bulb portion and hermetically sealed tube portion which is connected to the bulb portion, in which furthermore, in the bulb portion, there are electrically conductive supply components, and in which, by seal welding of the hermetically sealing bodies of electrically conductive cermet on the hermetically sealed tube portion with a sealing material, a hermetically sealed arrangement is obtained, the base parts of the above described electrically conductive supply components being inserted into the hermetically sealed bodies of electrically conductive cermet, the indicated object of the invention is obtained by an intermediate layer being formed in the area of the surface layers of the respective hermetically sealing body, the intermediate layer having components of the electrically conductive cermet of the hermetically sealing body intermixed with components of the sealing materials.

The expression "electrically conductive supply component" in a discharge lamp is defined as electrodes and the upholding parts of the electrode, and in an incandescent lamp, such as a halogen lamp or the like, filaments and inner lead pins.

The object is also achieved in accordance with the invention, in a ceramic lamp, by providing the electrically conductive cermet with components which melt at a temperature at which the sealing material melts and welding the hermetically sealing body to the hermetically sealed tube portion.

Furthermore, the object is achieved according to the invention in a ceramic lamp by having the noted intermediate layer have an area with a relatively small concentration gradient which is formed by a diffusion of the components of the sealing material into the intermediate layer and an area with a steep concentration gradient thereof.

Additionally, the object is advantageously achieved in accordance with the invention by the intermediate layer being an area with a thickness of at least 20 microns in which the concentration of the components of the sealing material is at least half the concentration in the pure sealing material.

Here, the expression "area of the intermediate layer with a thickness . . . " is defined mainly as the area in which the surface layers of the electrically conductive cermet are caused to melt, and in this way, components of the sealing material in a larger amount are able to diffuse into the molten material. This thickness, furthermore, represents the distance from a position at the outer surface of the cermet before seal welding to the inside as far as the position where the concentration of the components, which are distributed in the intermediate layer and which are contained in the sealing material, however are not contained in the electrically conductive cermet, reaches ½ of the initial concentration of these components in the sealing material.

The object is advantageously achieved in accordance with the invention especially in that the sealing material and the electrically conductive cermet contain the same component, specifically silicon dioxide.

Still further, the object is advantageously achieved according to the invention, in a ceramic lamp, by the sealing material filling at least a gap between inside faces of the hermetically sealing body and bordering outside faces of the hermetically sealed tube of the lamp vessel.

The object is also advantageously achieved in accordance with the invention, in a ceramic lamp, in that the surface of the electrically conductive cermet which faces outward of the lamp is at least partially covered with the sealing material.

Additionally, the object is advantageously achieved according to the invention, in a ceramic lamp, by the following conditions being met at the same time:

$$|\alpha_1-\alpha_2|\leqq 1\times10^{-6}(1/K)$$

$$|\alpha_2-\alpha_3|\leqq 1\times10^{-6}(1/K)$$

$$|\alpha_3-\alpha_1|\leqq 1\times10^{-6}(1/K)$$

where $\alpha_1$, $\alpha_2$, and $\alpha_3$ are, respectively, the average coefficients of linear expansion of the ceramic of the lamp vessel, the electrically conductive cermet of the hermetically sealing body and the sealing materials at 25° C. to 350° C.

Furthermore, the object is advantageously achieved in accordance with the invention by holes of the hermetically sealing body of electrically conductive cermet into which the base parts of the electrically conductive supply components are inserted each having a widened entry opening.

The object is also advantageously achieved according to the invention, in a ceramic lamp, by the condition $|y-u|\times d\leqq 1.2\times10^{-9}$ (m/K) being met where d (m) is the diameter of the electrically conductive supply components which are inserted into the hermetically sealing bodies of electrically conductive cermet, and where y and u (1/K) are the average coefficient of linear expansion of the electrically conductive cermet and of the material for the electrically conductive supply component at 25 to 350° C., respectively.

Additionally, the object is advantageously achieved in accordance with the invention, in a ceramic lamp, by the faces of the hermetically sealing body of electrically conductive cermet and the ends of the hermetically sealed tube of the lamp vessel being attached to one another with sealing material and sealed relative to one another, and by the difference between the outside diameter of the ends of the hermetically sealing body of electrically conductive cermet and the outside diameter of the ends of the hermetically sealed tube of the lamp vessel being less than or equal to 0.7 mm.

Still further, the object is advantageously achieved according to the invention, in a ceramic lamp, by the lamp being used in such a way that, in the operating state of the lamp, the temperature of the hermetically sealing body of electrically conductive cermet is kept constant at 760° C. or less.

When an intermediate layer is formed which is produced by the components of the electrically conductive cermet and the components of the sealing material in the area of the surface layers of the hermetically sealing body of electrically conductive cermet melting, and thus being mixed with one another, the connection of the sealing material with the hermetically sealing bodies of electrically conductive cermet is strengthened. At the same time, the stress which forms on the connection boundary between the sealing material and the hermetically sealing bodies of electrically conductive cermet is reduced.

Furthermore, by the measure according to the invention that the electrically conductive cermet contains components which melt at the operating temperature at which the sealing material melts and the hermetically sealing bodies in the hermetically sealed tube portion are sealed, the formation of an intermediate layer is promoted.

Also, by the measure in accordance with the invention that the above described intermediate layer has an area with a relatively small concentration gradient in which components of the sealing material are distributed and an area with a steep concentration gradient thereof, the stress on the connection boundary between the sealing material and the electrically conductive cermet is reduced. This means that components of the sealing material in a high concentration have been able to penetrate into the intermediate layer in the area near the tube portion (at a short distance to the applied sealing material) and the concentration gradient of these components is low in this area. As the distance from the applied sealing material increases, the concentration of the components of the sealing material which have diffused in becomes clearly less, the concentration gradient correspondingly greater. When this intermediate area has an area with a thickness of at least 20 microns when an area is reached in which the concentration of the components which have diffused in is cut in half, the reduction of the stress which occurs on the connection boundary is improved even more.

In addition, by the measure that the sealing material and the electrically conductive cermet contain the same component, specifically silicon dioxide, the temperature can be reduced at which the area of the surface layers of the cermet begins to melt. In this way, the formation of the intermediate layer is simplified even more.

Furthermore, in the production of the electrically conductive cermet, it becomes possible to sinter at a relatively lower temperature than with a conventional cermet.

In addition, because the sealing material extends as far as the face of the hermetically sealed tube portion of the lamp vessel, strong, highly hermetic sealing is produced.

Furthermore, because the electrically conductive cermet which face toward the lamp exterior is at least partially covered with the sealing material, the concentration of water absorbed on the outside surface of the electrically conductive cermet is reduced.

Also, because the differences between the three coefficients of linear expansion of the ceramic of the lamp vessel, the electrically conductive cermet of the hermetically sealing body and the sealing material is reduced to $\pm1\times10^{-6}$/K, the formation of macroscopic stress between the electrically conductive cermet and the lamp vessel is reduced.

In addition, because the opening diameter of the holes of the hermetically sealing body of electrically conductive cermet into which the base parts of the electrically conductive supply components are inserted is made larger than the inside diameter of the holes, the amount of coating of sealing material in the openings of the holes can be increased. Thus the stress in the vicinity of the openings is reduced.

Furthermore, by fixing the relation between the diameter of the electrically conductive supply components which are embedded in the hermetically sealing bodies of electrically conductive cermet and the average coefficient of linear expansion of the electrically conductive cermet and the electrically conductive supply components at 25 to 350° C., the formation of macroscopic stress between the electrically conductive cermet and the electrically conductive supply components is reduced.

Because the difference between the outside diameter of the ends of the hermetically sealing body of electrically conductive cermet and the outside diameter of the ends of the hermetically sealing tube of the lamp vessel is less than or equal to 0.7 mm, the sealing material is smoothly joined to the outside peripheral area of the hermetically sealed tube because only small stages between the two parts are present.

Furthermore, because in the operating state of the lamp the temperature of the hermetically sealing body of electrically conductive cermet is kept constant at less than or equal to 760° C., the thermal stress which forms between the respective substances within the electrically conductive cermet can be kept low.

In the following, the invention is further described using several embodiments shown in the drawings.

BRIEF DESCRIPTION OF THE DRAWINGS

FIG. 1 is a schematic cross section of an embodiment of a discharge lamp in accordance the invention;

FIG. 2 is a schematic cross section of another embodiment of a discharge lamp according to the invention;

FIG. 3 is a schematic depiction of an arrangement of a light irradiation heating device;

FIG. 10 shows a schematic cross section of a ceramic halogen lamp;

FIG. 11 shows a schematic cross section of a conventional discharge lamp of ceramic; and FIG. 12 is a table which represents the relation between the diameter of the upholding part of the electrode which is inserted into the hermetically sealing body of electrically conductive cermet, and the average coefficient of linear expansion of the electrically conductive cermet and the upholding part of the electrode, and the formation of cracks.

Figure 4:
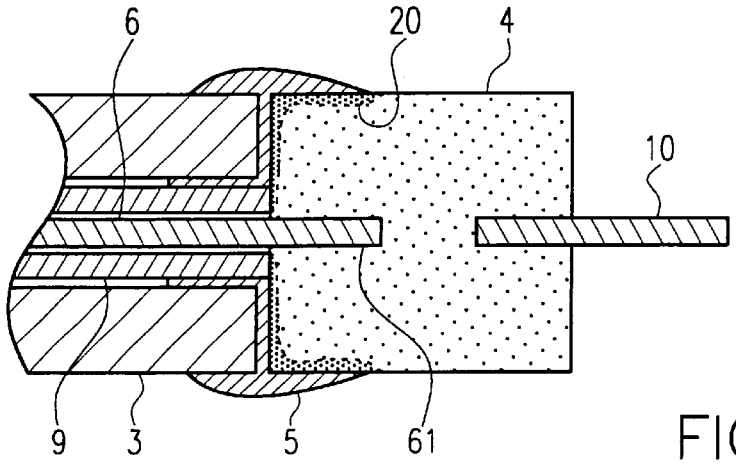
FIG. 4 is a schematic cross section of a hermetically sealed portion of a lamp in which an intermediate layer is formed.

DETAILED DESCRIPTION OF THE INVENTION (Embodiment 1)

FIG. 1 is a schematic cross section of one embodiment of a ceramic discharge lamp 1 in accordance with the invention. The lamp 1 is a 20 W metal halogen lamp. The outside diameter of the bulb portion 2 is 5.8 mm, the total length of the lamp is 24 mm, and the outside diameter of the hermetically sealed tube part 3 is 1.8 mm. The lamp vessel 2 contains 4 mg $DyI_3$—TlI—NaI, 2.6 mg of Hg and 13 kPa Ar as the filler gas. The hermetically sealing body 4 of electrically conductive cermet is columnar with an outside diameter of 1.8 mm and a length of 3.0 mm. The end face of the hermetically sealed tube part 3 and the end face of the hermetically sealing body 4 are sealed via sealing material 5 creating a hermetically sealed portion 7.

The lamp vessel 1 is made of translucent ceramic which is a sintered body of polycrystalline aluminum oxide. The bulb portion 2 of lamp vessel 1 is connected to the hermetically sealed tube portion 3, in this embodiment, by being integrally sintered to one another. However, as is shown in FIG. 2, in another embodiment of a ceramic discharge lamp according to the invention, the bulb portion 2 and the hermetically sealed tube part 3 are temporarily sintered separately, then combined with one another, then completely sintered and formed. For the lamp vessel 1, furthermore, a polycrystalline YAG sintered body or a polycrystalline yttrium oxide sintered body, or the like, is used.

In FIG. 1, within the bulb portion 2, there is a pair of electrodes 8 opposite one another. For each electrode 8, the tip of the upholding part 6 of the electrode is wound with a metal coil and is arranged together with the upholding part 6 of the electrode as an electrically conductive supply component. The base part 61 of each upholding part 6 of the electrode is inserted into a hermetically sealing body 4 of electrically conductive cermet. Tungsten or molybdenum is used for the electrodes 8 and the upholding part 6 of the electrode. Furthermore, in this embodiment, there is a sleeve 9 of aluminum oxide.

For the electrically conductive cermet which is used as the hermetically sealing body 4, a mixture of Mo—$Al_2O_3$—MgO—$SiO_2$ (40:35:15:10% volumetric proportion) is used. The composition of the cermet is, however, not limited thereto, but can be changed with consideration of the coefficient of linear expansion of the material of the lamp vessel 1 to be used, for example, a suitable choice of 5 to 30% of silicon dioxide content being made.

The above described electrically conductive cermet based on Mo—$Al_2O_3$—MgO—$SiO_2$ is produced by pressing the raw powder of fine particles of 5 microns or less of the respective material component, yielding a compacted body. This compacted body was heated at 1700° C. for 5 minutes and sintered.

As is shown in FIG. 1, the ends of the hermetically sealed tube and the hermetically sealing body 4 of electrically conductive cermet are sealed to one another by welding using a sealing material 5, by which a hermetically sealed arrangement is formed on both ends in this embodiment. The sealing material 5 extends to the outer surface of the sealed tube portion 3 of the lamp vessel 1, a mixture of $Dy_2O_3$—$Al_2O_3$—$SiO_2$ being used as the sealing material.

For seal welding, a light irradiation heating device is used which is also called a "photo image furnace" and in which visible radiation and IR light are emitted from a radiation source and are focused by a reflector at a focal point, so that a substance which has been placed at the focal point is briefly heated by increasing the temperature. The radiation source of the visible rays and IR light is a halogen lamp, a xenon lamp or the like. Furthermore, it is possible to use an IR laser as the radiation source.

FIG. 3 is a schematic of the arrangement of a light irradiation heating device which was used to form this embodiment. For the light source, two halogen lamps 11 with a power of 1 kW were used. The visible rays and the IR rays emitted by the halogen lamps 11 were focused by means of a reflector 12 on the hermetically sealed portions 7 of the lamp vessel 1 which was located in a translucent vacuum vessel 13. The sealing material was briefly heated, i.e., for only a few seconds, thus melted, and afterwards, it was held at the temperature at which the molten sealing material is brought into a solid phase for a certain time, i.e., roughly 20 seconds, by which sealing has taken place.

The light irradiation heating raises the temperature of the sealing material, which conventionally melts at roughly 1600° C., for an instant to roughly 1800° C., at which the operating temperature for sealing the hermetically sealed portions lies. At this operating temperature, the material components of the electrically conductive cermet partially melt.

When the hermetically sealing body 4 on the hermetically sealed tube portion 3 is sealed by means of the sealing material 5 by welding, an intermediate layer 20 is formed in the area of the surface layers of the hermetically sealing body 4 in which the components of sealing material 5 and the material components of the electrically conductive cermet are mixed with one another. This state is shown schematically in FIG. 4.

In this embodiment, because both the electrically conductive cermet and also the sealing material contain the same component, silicon dioxide, which melts at the operating temperature for sealing, i.e., at roughly 1800° C., the material components of the electrically conductive cermet of the hermetically sealing body 4 in the area of the surface layers of the body 4 melt when the sealing material melts.

Figure 5:
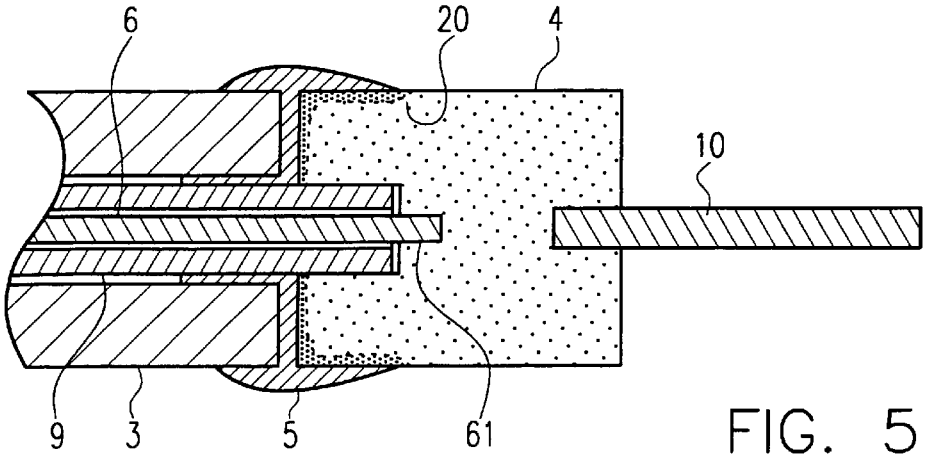
FIG. 5 is a schematic cross section of another embodiment of a hermetically sealed portion of a lamp in which an intermediate layer is formed.

FIG. 5 shows another embodiment of the type of lamp according to the invention in which a sleeve 9 of ceramic is held in a concave area with which the inside face of the hermetically sealing body 4 of electrically conductive cermet is provided.

In the area of the surface layers of the hermetically sealing body 4, the components of the electrically conductive cermet melt, forming a liquid phase. Since, in general, the diffusion rate of the molecules in the liquid phase is far greater than the diffusion rate of the solid phase, during the short time of photoheating, a layer is formed in which the components of the sealing material and the components of the electrically conductive cermet are distributed and mixed with one another. It is assumed that, by forming this layer, the stress is distributed which forms at the boundary between the sealing material and the electrically conductive cermet. In this invention, the layer formed by this mixing is called the "intermediate layer 20."

It was found that, in this embodiment, in the intermediate layer 20, there is an area with a relatively small concentration gradient of the distributed $Dy_2O_3$ and there is an area with a steeply dropping concentration gradient thereof, when preferably $Dy_2O_3$ is considered as the component which is contained in the sealing material, but not in the electrically conductive cermet, in order to check the concentration distribution of the components of the sealing material in the intermediate layer.

Figure 6:
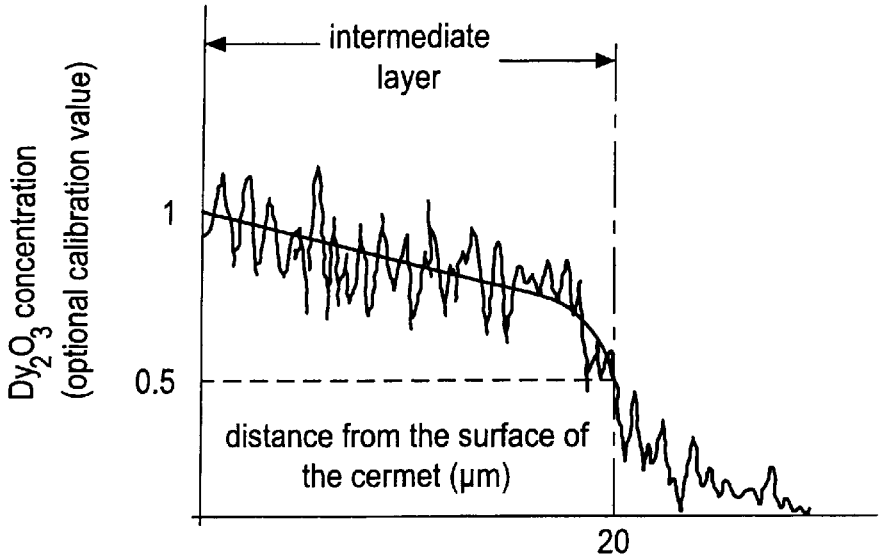
FIG. 6 is a graph showing the concentration gradient of $Dy_2O_3$ in one example of the intermediate layer.

The concentration gradient formed by the diffusion thereof is shown by way of example in FIG. 6, which can be confirmed by SEM-EDS (scanning electron microscopy and x-ray analysis). Furthermore, an area with a thickness of at least 20 microns in the intermediate layer of the finished hermetically sealed portion can also be ascertained within which the concentration has not yet been reduced by diffusion to less than half the concentration in the sealing material used. Only at a distance of greater than 20 microns from the surface of the metal ceramic is the concentration of the components of the sealing material in the intermediate layer less than half the concentration of the pure sealing material. This thickness can be measured by SEM-EDS.

Especially in this embodiment, by the measure that the electrically conductive cermet contains silicon dioxide and is heated to 1800° C., i.e., to a relatively low temperature, an area is easily obtained in which the thickness is greater than or equal to 20 microns when the concentration of the scattered components of the sealing material of the intermediate layer has retreated to half.

Furthermore, by the arrangement of the sealing material such that the sealing material melts and the surface of the electrically conductive cermet is covered therewith, and by photoheating and seal welding being performed, the lateral outside surface of the electrically conductive cermet which is adjacent to the end of the tube portion is covered with the sealing material in the finished hermetically sealed portions.

In this embodiment, the material is chosen such that the following conditions are met at the same time:

$$|\alpha_1-\alpha_2|\leqq 1\times10^{-6}(1/K)$$

$$|\alpha_2-\alpha_3|\leqq 1\times10^{-6}(1/K)$$

$$|\alpha_3-\alpha_1|\leqq 1\times10^{-6}(1/K)$$

where $\alpha_1$, $\alpha_2$, and $\alpha_3$ (unit: 1/K) are, respectively, the average coefficients of linear expansion of the ceramic of the lamp vessel, the electrically conductive cermet of the hermetically sealing body and the sealing material at 25° C. to 350° C.

Specifically, the average coefficients of linear expansion of the sintered body of the polycrystalline aluminum oxide as the ceramic of the lamp vessel are $6.8\times10^{-6}$/K, of the cermet based on Mo—$Al_2O_3$—MgO—$SiO_2$ as the electrically conductive cermet are $6.5\times10^{-6}$/K at 25 to 350° C. and of the sealing material based on $Dy_2O_3$—$Al_2O_3$—$SiO_2$ at 25 to 350° C. are $6.6\times10^{-6}$/K.

The stress exerted on the sealing material, which often causes cracks, can be reduced by this choice of the ceramic of the lamp vessel, the electrically conductive cermet of the hermetically sealing body, and the sealing material with similar coefficients of linear expansion.

Furthermore, for comparison purposes, a lamp was produced using an electrically conductive cermet of $Al_2O_3$—Mo. The average coefficient of linear expansion of this cermet at 25 to 350° C. is $5\times10^{-6}$/K. The difference between the coefficients of linear expansion of the translucent sintered body of polycrystalline aluminum oxide of the lamp vessel and of the sealing material based on $Dy_2O_3$—$Al_2O_3$—$SiO_2$ and this electrically conductive cermet is greater than $1\times10^{-6}$/K. In this lamp, it was confirmed that there are cases in which cracks form in the hermetically sealed portions.

Figure 7:
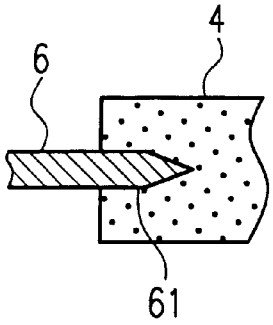
FIG. 7 schematically illustrates an embodiment in which the diameter of the base part of the upholding part of the electrode is gradually reduced in the vicinity of the tip.

Furthermore, as shown in FIG. 7, as another embodiment of the invention, the diameter of the base part of the upholding part 6 of the electrode in the vicinity of its tip is progressively reduced in order to increase the reliability of the hermetically sealed portion. This measure reduces the stress in the vicinity of the base part of the upholding part 6 of the electrode in the electrically conductive cermet.

Figure 8:
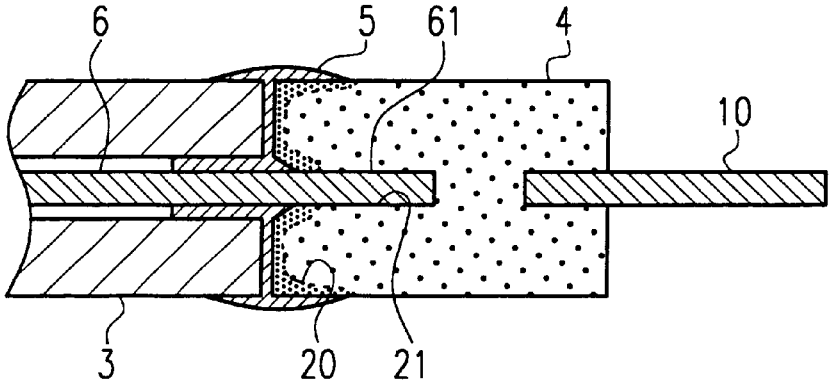
FIG. 8 is a schematic cross section showing the intermediate layer in the case in which the hole of the hermetically sealing body of electrically conductive cermet, in which the base part of the upholding part of the electrode is inserted, has a widened opening.

In addition, a lamp was produced using the hermetically sealing body 4 of electrically conductive cermet with holes 21 which each have a widened opening in which the base parts of the upholding part 6 of the electrode are inserted. In this case, it was possible, as is shown in FIG. 8, to enlarge the intermediate layer 20 which is formed around the upholding part of the electrode of the hermetically sealing body.

Figure 9:
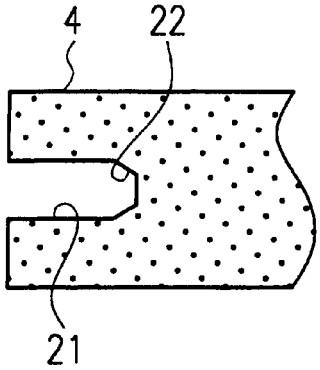
FIG. 9 shows one example in which the bottom surface of the hole of the hermetically sealing body of electrically conductive cermet, in which the base part of the upholding part of the electrode is inserted, is polyhedral.

Furthermore, the bottom surface 22 of the hole 21 of the hermetically sealing body of electrically conductive cermet in which the base part of the upholding part of the electrode is inserted, was made in the form of a polyhedral, convex surface as is illustrated in FIG. 9. This was done by a pin with a polyhedral tip shape being placed in the press mold to keep the hole 21 open when pressing the raw powder before sintering of the cermet. Also the shape of the base part of the upholding part of the electrode corresponding to the hole was matched to the polyhedral convex surface of the bottom. This measure can prevent formation of cracks locally.

Furthermore, the material was chosen such that the condition $|y-u|\times d\leqq 1.2\times10^{-9}$ is met where d (mm) is the diameter of the upholding parts 6 of the electrode 8 which are inserted into the hermetically sealing bodies of electrically conductive cermet and y and u (1/K) are the average coefficients of linear expansion of the electrically conductive cermet and of the upholding part of the electrode at 25 to 350° C., respectively. In particular, an advantageous value for d is 0.3 mm, for y is $6.5\times10^{-6}$/K, and for u is $4.7\times10^{-6}$/K. This reduces the formation of macroscopic stress between the upholding part of the electrode and the electrically conductive cermet.

FIG. 12 shows the results of an experiment in which the upholding parts of the electrode were inserted into the electrically conductive cermet, the entirety was sintered and the presence or absence of cracks was checked to select the above described numerical values. The cracks were observed at the locations at which the inserted upholding parts of the electrodes project out of the electrically conductive cermet.

In this experiment, tungsten as the upholding part of the electrode and electrically conductive cermet based on Mo—$Al_2O_3$ (coefficient of linear expansion: $5.7\times10^{-6}$/K) and Mo—MgO—$Al_2O_3$—$SiO_2$ (coefficient of linear expansion: $7.2\times10^{-6}$) were used. In the latter cermet, the coefficient of linear expansion can be controlled by changing the ratio of the composition of MgO and $Al_2O_3$.

In the Table in FIG. 12, the ratio of the formation of cracks is represented using a fraction, the nominator being the number of samples and the denominator being the number of lamps where cracks have formed. These results show that a ceramic lamp in which no cracking occurs can be obtained by the material of the electrically conductive cermet of the hermetically sealing body, the material of the upholding part of the electrode and the diameter of the upholding part of the electrode being selected in the range from $|y-u|\times d \leqq 1.2\times10^{-9}$ (m/K).

Furthermore, in this embodiment, the ends of the hermetically sealing body of electrically conductive cermet and the end of the hermetically sealed tube of the lamp vessel were sealed relative one another. Both the outside diameter of the ends of the hermetically sealing body of electrically conductive cermet and also the outside diameter of the end of the hermetically sealed tube of the lamp vessel are 1.8 mm.

Furthermore, a lamp was produced and a check was performed in which the difference between the outside diameter of the electrically conductive cermet and the outside diameter of the end of the hermetically sealed tube of the lamp vessel was changed. This showed that at values of 0.7 mm or less, the sealing material is smoothly connected to the outside peripheral area of the hermetically sealed portion, and on the end of the sealing material, after adhesion, no cracking occurs. However, when the difference between the outside diameter of the electrically conductive cermet and the outside diameter of the end of the hermetically sealed tube of the lamp vessel is greater than 0.7 mm, the sealing material is not smoothly joined. Here, it was confirmed that there are cases in which cracks formed in the connection area between the electrically conductive cermet and the end of the hermetically sealed tube of the lamp vessel. In this embodiment, the sealing material extended as far as the face of the hermetically sealed tube of the lamp vessel.

Furthermore, in the lamp in this embodiment, it could be foreseen that, in the hermetically sealed portions, the failure rate is thus as good as 0 in that, in the operating state of the lamp, the temperature of the hermetically sealing body of the electrically conductive cermet is kept constant at less than or equal 760° C.

(Embodiment 2)

FIG. 10 shows a 4 kW ceramic halogen lamp 31 in which the outside diameter of the bulb portion 40 is 10 mm and the total length is 520 mm. As the filling gas, Ar+$CH_2Br_2$ (0.1% by volume) with a pressure of 70 kPa were added. The faces of the hermetically sealed tube portions 41 and the faces of the hermetically sealing bodies 32 are sealed relative to one another via the sealing material 33.

The lamp vessel 31 is made of a translucent sintered body of a polycrystalline aluminum oxide. Furthermore, the hermetically sealing body 32 is made of an electrically conductive cermet based on Mo—$Al_2O_3$—MgO—$SiO_2$ (40:35:15:10% volumetric proportion). The sealing material 33 used is based on $Dy_2O_3$—$Al_2O_3$—$SiO_2$. Also shown in FIG. 10 are an inner lead pin 34, a filament 35, and an outer lead pin 36.

As in embodiment 1, using a photoheating device, hermetically sealed portions 37 were seal welded by means of the sealing material. In the area of the surface layers of the hermetically sealing body 32 of electrically conductive cermet, intermediate layers 20 were formed. The intermediate layer 20 had a thickness of roughly 50 microns in its thicker area. In the halogen lamp in this embodiment, the temperature of the hermetically sealed portions in operation were at most 650° C.

In the following, experiments are described by way of example in which the reliability of the hermetically sealed portions of the ceramic lamp according to the invention was confirmed. Temperature cycle experiments were run which are essentially explained in the following. A lamp of the double tube type was used which has the ceramic discharge lamp of the invention as the inner tube.

(Temperature cycle experiment)

(1) Temperature-load Conditions:

The lamp output was controlled such that the temperature of the hermetically sealed portions was 800° C. The lamp was operated for 15 minutes and turned off for 15 minutes; this was considered one cycle. The experiment was completed after 3000 cycles.

(2) Process for Evaluation of Reliability of the Hermetically Sealed Portions:

When, during the experiment, leakage of the lamp occurs, the experiment is stopped. The leakage is determined by the materials added to the inner tube being deposited on the inside of the outer tube of the double tube.

After completion of the experiment, an appearance test was performed and the presence or absence of cracks visually checked in the hermetically sealed portions.

(3) Number of Samples: 30

This temperature cycle experiment was performed with the lamps described below:

(Experiment 1)

Sample lamp:
- 20 W Metal halogen lamp (lamp of the double tube type in which the lamp with the arrangement shown in FIG. 1 was used as the inner tube)

Lamp vessel: translucent, sintered body of a polycrystalline aluminum oxide;

Outside diameter of the hermetically sealed tube and the hermetically sealing body:
- 1.8 mm for both Electrically conductive cermet:
- Based on Mo—$Al_2O_3$—MgO—$SiO_2$ (40:35:15:10% volumetric proportion)

Sealing material:
- Based on $Dy_2O_3$—$Al_2O_3$—$SiO_2$

Substances added to the lamp vessel:
- $DyI_3$—TlI—NaI: 4 mg
- Hg: 2.6 mg
- Ar: 13 kPa Lamp characteristic:
- Voltage: 70 V, current: 0.3 A, efficiency: 901 m/W
- Color temperature: 3000 K,
- Evaluation index of the color reproduction: 80

Experimental result
- In this lamp, during 3000 cycles, in none of the 30 lamps did cracking or a leak occur.

(Experiment 2)

Sample lamp:

10 W Metal halogen lamp (lamp of the double tube type in which the lamp with the arrangement shown in FIG. 1 used as the inner tube)

Lamp vessel: translucent, sintered body of a polycrystalline aluminum oxide; Outside diameter of the hermetically sealed tube and the hermetically sealing body: 1.8 mm for both Electrically conductive cermet:

Based on Mo—$Al_2O_3$—MgO—$SiO_2$ (40:35:15:10% volumetric proportion)

Sealing material:

Based on $Dy_2O_3$—$Al_2O_3$—$SiO_2$

Substances added to the lamp vessel:

$NdI_3$—NaI: 3 mg

Hg: 1.5 mg

Ne-Ar: 45 kPa

Lamp characteristic:

Voltage: 70 V, current: 0.15 A, efficiency: 901 m/W

Color temperature: 3000 K,

Evaluation index of the color reproduction: 80

Experimental result

For this lamp as well, during 3000 cycles, in none of the 30 lamps did cracking or a leak occur.

(Experiment 3)

Sample lamp:

70W Metal halogen lamp (lamp of the double tube type in which the lamp with the arrangement shown in FIG. 1 was used as the inner tube)

Lamp vessel: translucent, sintered body of a polycrystalline aluminum oxide:

Outside diameter of the hermetically sealed tube and the hermetically sealing body:

2.1 mm for both

Electrically conductive cermet:

Based on Mo—$Al_2O_3$—MgO—$SiO_2$ (40:20:30:10% volumetric proportion)

Sealing material:

Based on $Dy_2O_3$—$Al_2O_3$—$SiO_2$

Substance added to the lamp vessel:

$DyI_3$—$TmI_3$—TlI-NaI: 6 mg

Hg: 4 mg

Ar: 10 kPa

Lamp characteristic:

Voltage: 85 V, current: 0.9 A, efficiency: 951 m/W,

Color temperature: 3000 K,

Evaluation index of the color reproduction: 86

Experimental result

For this lamp as well, during 3000 cycles, in none of the 30 lamps did cracking or a leak occur.

(Experiment 4)

For purposes of comparison with the ceramic lamps according to the invention, a lamp was produced under the same conditions as in the above described experiment 3, except for the condition of the electrically conductive cermet, and the temperature cycle experiment was performed.

Sample lamp:

70 W Metal halogen lamp (lamp of the double tube type in which the lamp with the arrangement shown in FIG. 1 was used as the inner tube)

Lamp vessel: translucent, sintered body of a polycrystalline aluminum oxide;

Outside diameter of the hermetically sealed tube and the hermetically sealing body:

2.1 mm for both electrically conductive cermet:

Based on Mo—$Al_2O_3$—MgO (40:40:20% volumetric proportion)

Sealing material:

Based on $Dy_2O_3$—$Al_2O_3$—$SiO_2$

Substances added to the lamp vessel:

$DyI_3$—$TmI_3$—TlI—NaI: 6 mg

Hg: 4 mg

Ar: 10 kPa

Lamp characteristic:

Voltage: 85 V, current: 0.9 A, efficiency: 951 m/W

Color temperature: 3000 K,

Evaluation index of the color reproduction: 86

Experimental result

In this lamp, on the 1642nd time and on the 2547th time leaks occurred in one of the 30 lamps, each time. In the remaining 28 lamps, after 3000 times in four lamps cracks in the hermetically sealed portions were found, but no leakage occurred. In experiment 4, therefore, a lamp defect occurred in six of the 30 lamps. It was not possible to obtain a lamp with high reliability of the hermetically sealed portions.

Action of the Invention

As was described above, in the ceramic lamp according to the invention, when the sealing material melts in the area of the surface layers of the electrically conductive cermet of the respective hermetically sealing body, an intermediate layer is formed, by which the difference between the coefficient of linear expansion of the lamp components is reduced. Furthermore, the sealing material was joined to the electrically conductive cermet with an extremely good adhesive property. The reliability of the hermetically sealed portions of the lamp was thus greatly increased compared to a conventional lamp in which the electrically conductive cermet was sealed by a sealing material.

What we claim is:

1. Ceramic lamp of translucent ceramic having a lamp vessel with a bulb portion and hermetically sealed tube portions connected to the bulb portion, electrically conductive supply components in the bulb portion, and hermetically sealing bodies of electrically conductive cermet weld on the hermetically sealed tube portions with a sealing material to form a hermetically sealed arrangement, base parts of the electrically conductive supply components held in the hermetically sealed bodies of electrically conductive cermet; wherein an intermediate layer is formed in a surface area of the hermetically sealing body, components of the electrically conductive cermet of the hermetically sealing body being intermixed with components of the sealing materials in said intermediate layer.

2. Ceramic lamp as claimed in claim 1, wherein the electrically conductive cermet contains components which melt at a temperature at which the sealing material melts and of which the hermetically sealing bodies are welded to the hermetically sealed tube portion.

3. Ceramic lamp as claimed in claim 1, wherein the intermediate layer is comprised of an area with a relatively small concentration gradient which is formed by a diffusion of components of the sealing material into the intermediate layer, and of an area with a steep concentration gradient of components of the sealing material.

4. Ceramic lamp as claimed in claim 3, wherein the intermediate layer is an area with a thickness that is greater than or equal to 20 microns and in which the concentration of the components of the sealing material is at least half the concentration of said components in the pure sealing material.

5. Ceramic lamp as claimed in claim 4, wherein the sealing material and the electrically conductive cermet contain silicon dioxide as a common component.

6. Ceramic lamp as claimed in claim 5, wherein inside faces of the hermetically sealing body border outside faces of the hermetically sealed tube of the lamp vessel, and wherein the sealing material fills at least a gap between said faces.

7. Ceramic lamp as claimed in claim 6, wherein an outwardly facing surface of the electrically conductive cermet is at least partially covered with the sealing material.

8. Ceramic lamp as claimed in claim 7, wherein the following conditions are met at the same time:

$$|\alpha_1-\alpha_2|\leqq 1\times10^{-6}(1/K)$$

$$|\alpha_2-\alpha_3|\leqq 1\times10^{-6}(1/K)$$

$$|\alpha_3-\alpha_1|\leqq 1\times10^{-6}(1/K)$$

where $\alpha_1$, $\alpha_2$, and $\alpha_3$ are the average coefficients of linear expansion of the ceramic of the lamp vessel, the electrically conductive cermet of the hermetically sealing body and the sealing materials at 25° C. to 350° C., respectively.

9. Ceramic lamp as claimed in claim 8, wherein each of the hermetically sealing bodies of electrically conductive cermet has a hole into which a respective one of the base parts of the electrically conductive supply components are inserted, said hole having a widened entry opening.

10. Ceramic lamp as claimed in claim 9, wherein the condition $|y-u|\times d\leqq 1.2\times10^{-9}$ (m/K) is met where d (m) is the diameter of the electrically conductive supply components which are inserted into the hermetically sealing bodies of electrically conductive cermet and y and u (1/K) are the average coefficients of linear expansion of the electrically conductive cermet and of the material for the electrically conductive supply component at 25 to 350° C., respectively.

11. Ceramic lamp as claimed in claim 10, wherein the ends of the hermetically sealing bodies of electrically conductive cermet and the ends of the hermetically sealed tube of the lamp vessel are attached to one another and are sealed relative to one another with said sealing material and a difference between an outside diameter of the ends of the hermetically sealing body of electrically conductive cermet and an outside diameter of the ends of the hermetically sealed tube of the lamp vessel is 0.7 mm or less.

12. Ceramic lamp as claimed in claim 1, wherein the intermediate layer is comprised of an area with a relatively small concentration gradient which is formed by a diffusion of components of the sealing material into the intermediate layer, and of an area with a steep concentration gradient of components of the sealing material.

13. Ceramic lamp as claimed in claim 1, wherein the intermediate layer is an area with a thickness that is greater than or equal to 20 microns and in which the concentration of the components of the sealing material is at least half the concentration of said components in the pure sealing material.

14. Ceramic lamp as claimed in claim 1, wherein the sealing material and the electrically conductive cermet contain silicon dioxide as a common component.

15. Ceramic lamp as claimed in claim 1, wherein inside faces of the hermetically sealing body border outside faces of the hermetically sealed tube of the lamp vessel, and wherein the sealing material fills at least a gap between said faces.

16. Ceramic lamp as claimed in claim 1, wherein an outwardly facing surface of the electrically conductive cermet is at least partially covered with the sealing material.

17. Ceramic lamp as claimed in claim 1, wherein the following conditions are met at the same time:

$$|\alpha_1-\alpha_2|\leqq 1\times10^{-6}(1/K)$$

$$|\alpha_2-\alpha_3|\leqq 1\times10^{-6}(1/K)$$

$$|\alpha_3-\alpha_1|\leqq 1\times10^{-6}(1/K)$$

where $\alpha_1$, $\alpha_2$, and $\alpha_3$ are the average coefficients of linear expansion of the ceramic of the lamp vessel, the electrically conductive cermet of the hermetically sealing body and the sealing materials at 25° C. to 350° C., respectively.

18. Ceramic lamp as claimed in claim 1, wherein each of the hermetically sealing bodies of electrically conductive cermet has a hole into which a respective one of the base parts of the electrically conductive supply components are inserted, said hole having a widened entry opening.

19. Ceramic lamp as claimed in claim 1, wherein the condition $|y-u|\times d\leqq 1.2\times10^{-9}$ (m/K) is met where d (m) is the diameter of the electrically conductive supply components which are inserted into the hermetically sealing bodies of electrically conductive cermet and y and u (1/K) are the average coefficients of linear expansion of the electrically conductive cermet and of the material for the electrically conductive supply component at 25 to 350° C., respectively.

20. Ceramic lamp as claimed in claim 1, wherein the ends of the hermetically sealing bodies of electrically conductive cermet and the ends of the hermetically sealed tube of the lamp vessel are attached to one another and are sealed relative to one another with said sealing material and a difference between an outside diameter of the ends of the hermetically sealing bodies of electrically conductive cermet and an outside diameter of the ends of the hermetically sealed tube of the lamp vessel is 0.7 mm or less.

* * * * *